US005111891A

United States Patent [19]

Kinnan

[11] Patent Number: 5,111,891

[45] Date of Patent: May 12, 1992

[54] BORING HEAD FOR A SUBSURFACE SOIL-BORING APPARATUS

[75] Inventor: Frank R. Kinnan, Camas Valley, Oreg.

[73] Assignee: Underground Technologies, Byron, Calif.

[21] Appl. No.: 610,520

[22] Filed: Nov. 8, 1990

[51] Int. Cl.[5] ..... E21B 7/26

[52] U.S. Cl. ..... 175/21; 175/45

[58] Field of Search ..... 175/19, 21, 45, 61, 175/67

[56] References Cited

U.S. PATENT DOCUMENTS

| | | | |
|---|---|---|---|
| 3,131,778 | 5/1964 | Emerson et al. | 175/45 |
| 3,572,839 | 3/1971 | Okabe | 175/67 X |
| 3,797,586 | 3/1974 | Coyne et al. | 175/19 X |
| 4,013,134 | 3/1977 | Richmond et al. | 175/61 X |
| 4,042,046 | 8/1977 | Capoccia | 175/45 X |
| 4,258,800 | 3/1981 | Hipp | 175/61 |
| 5,002,138 | 3/1991 | Smet | 175/61 X |

*Primary Examiner*—Ramon S. Britts

*Assistant Examiner*—Roger J. Schoeppel

*Attorney, Agent, or Firm*—Lerner, David, Littenberg, Krumholz & Mentlik

[57] ABSTRACT

A steerable subsurface soil-boring head arranged to be rotated and advanced by a pipe string operated by an above-surface drilling apparatus which also provides a supply of high-pressure fluid emitted from a nozzle in the head as an eroding jet stream. The head comprising a body portion coupled to a pipe string and a nose portion hingedly coupled to the body portion with a biasing mechanism coupled therebetween to align the head portions. The head when rotated and advanced retains the nose portion and body portion in alignment due to the rotation of the head and the effect of the biasing mechanism. When advanced without rotation, the nose portion pivots about the hinged coupling and compresses the biasing mechanism to follow the contour of the cavity ahead of the nose portion. The body portion and the nose portion return to alignment when the head is rotated due to rotation and recovery of the biasing mechanism.

20 Claims, 6 Drawing Sheets

BORING HEAD FOR A SUBSURFACE SOIL-BORING APPARATUS

BACKGROUND OF THE INVENTION

1. Field of the Invention

The invention is directed to the field of subsurface soil boring and more particularly to the field of generally horizontal boring of bores for the installation of utility items such as electrical cables and conduit, gas, water and other fluid-carrying ducts and pipes and similar items without disturbing the surface above such bores.

2. Description of the Prior Art

Other known steerable heads are formed of a single unit with a nose portion that is asymmetrical having jet nozzles and at least one surface of such nose portion set at an acute angle to the longitudinal axis of the head. The inclined surface of the nose portion is able to follow the contour of the cavity in which the head is placed when the head is advanced without rotation by its attached pipe string. Once the head is properly positioned in its new direction of travel, it is rotated and advanced again.

The asymmetrical nature of the head makes it rotate unevenly requiring additional advancing force and the presence of the inclined surface makes it wander and is subject to unwanted deflection and thus resultant changes of direction when an object or hard or compacted soil is encountered requiring numerous retractions and course corrections. One such head is shown in U.S. Pat. No. 4,674,579 issued Jun. 23, 1987, entitled Method and Apparatus for Installment of Underground Utilities by Edward Galler et al.

SUMMARY OF THE INVENTION

The present invention overcomes the difficulties presented by such prior art boring heads by providing a symmetrical boring head which can be advanced evenly at a uniform rate and which minimizes any tendency to wander created by the inclusion of a non-symmetrical inclined surface on the nose portion of such head. The inclined surface required for steering is introduced by the provision of a nose portion which is hinged to and biased towards a body portion and maintained in alignment with such body portion when rotated due to such rotation and the biasing means. When the head is advanced without rotation, the nose portion is permitted to follow the contour of the bore surface pivoting about the hinge and compressing the biasing means. When the nose portion is in its correct directional position, rotation of the head may begin, the rotation and biasing means returning to its initial position aligning the nose and body portions so that boring can resume in the newly selected direction. It is therefore an object of this invention to provide a novel steerable boring head.

It is an object of this invention to provide a novel steerable boring head having a nose portion hingedly coupled to a body portion.

It is another object of this invention to provide a novel steerable boring head having a nose portion hingedly coupled to a body portion and biased to attempt to align said nose portion with said body portion.

It is still another object of this invention to provide a novel steerable boring head having a nose portion hingedly coupled to a body portion and biased to align said nose portion with said body portion when said boring head is rotated.

It is yet another object of this invention to provide a novel steerable boring head having a nose portion hingedly coupled to a body portion, said nose portion pivoting about said hinged coupling to follow the contour of the bore to allow said head to change direction when said head is advanced without rotation.

It is another object of this invention to provide a novel steerable boring head having a nose portion hingedly coupled to a body portion and having biasing means therebetween to align said nose portion and body portion, the rotation of said boring head and the effects of said biasing means when said nose portion is displaced from its aligned position with said body portion tending to return said nose portion and said body portion to their aligned position.

Other objects and features of the invention will be pointed out in the following description and claims and illustrated in the accompanying drawings which disclose, by way of example, the principles of the invention, and the best modes which have been contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
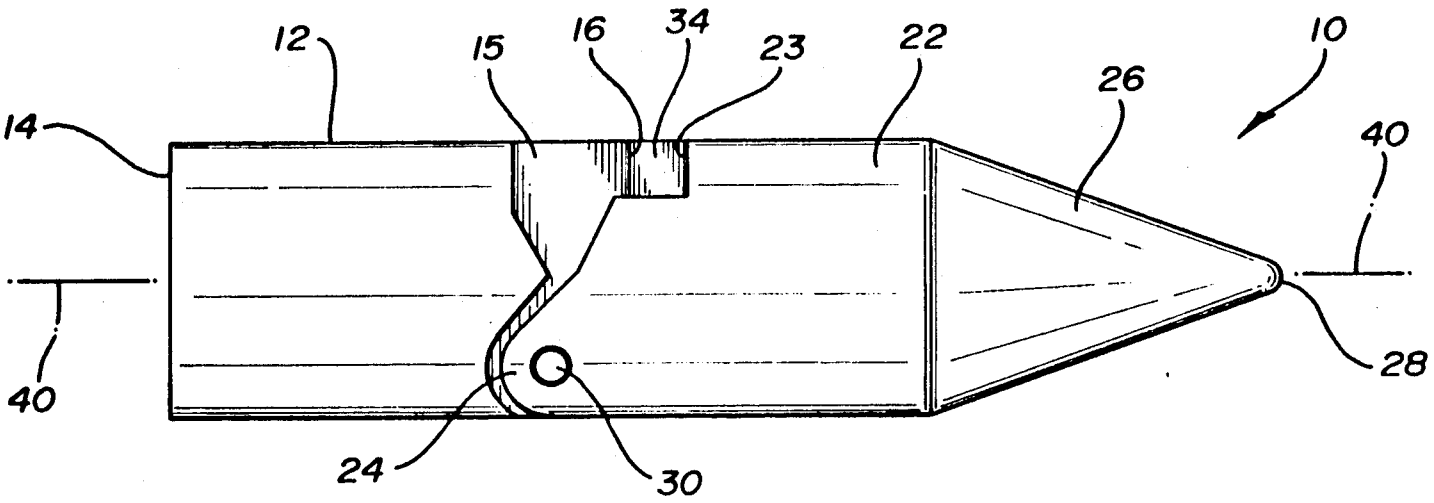
FIG. 1 is a side elevational view of a steerable subsurface soil boring head constructed in accordance with the concepts of the invention.
Figure 2:
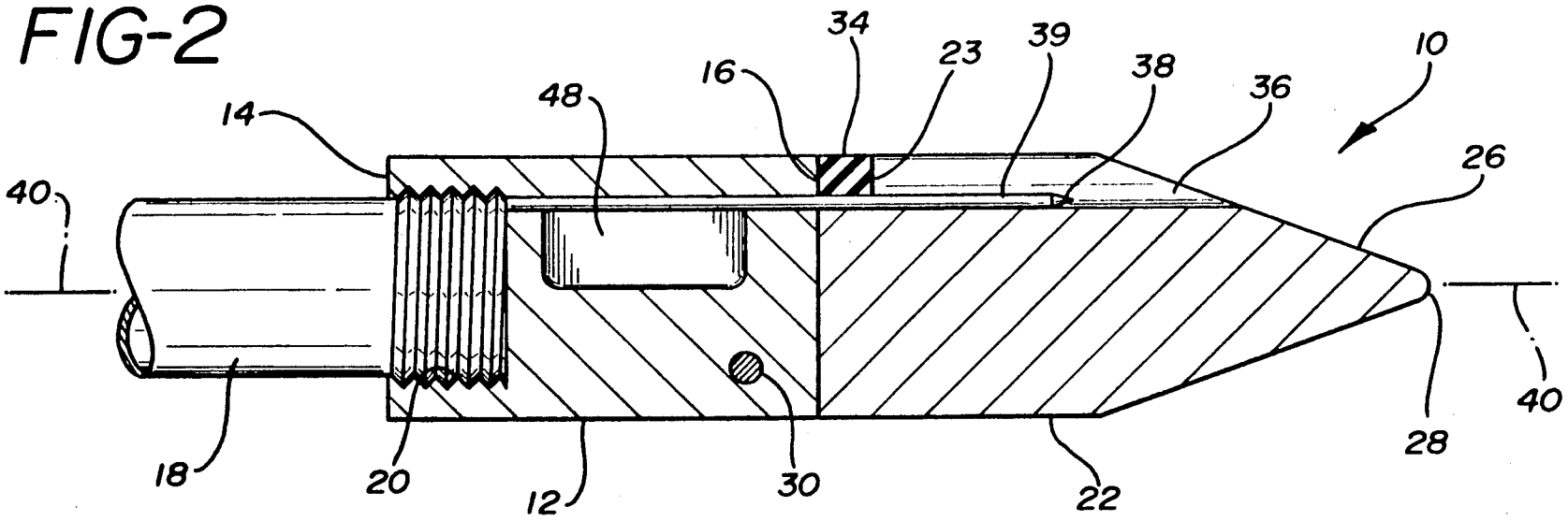
FIG. 2 is a side elevational view, partially in section, of the boring head of FIG. 1 showing the internal details thereof and showing same connected to the end of a drill pipe string.
Figure 3:
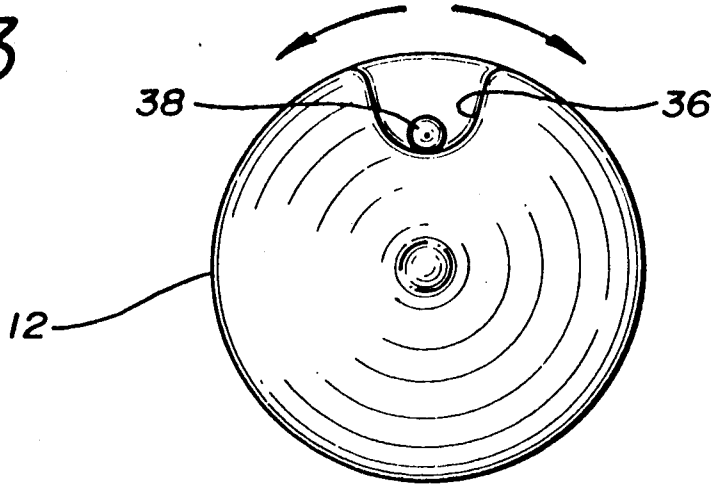
FIG. 3 is a front elevational view of the boring head of FIG. 4.

Turning now to FIGS. 1, 2 and 3, there is shown a steerable subsurface soil-boring head 10 constructed in accordance with the concepts of the invention. Boring head 10 has a cylindrical body portion 12 internally threaded as at 20 adjacent a first end 14. Body portion 12 may be coupled to the end of a drill pipe string 18 to which a surface mounted apparatus (not shown) selectively applies rotation and advance/withdrawal. Further, such apparatus will supply through such drill pipe string fluid at high pressure. An apparatus of the type generally described is shown, described and claimed in U.S. Pat. No. 4,957,173 issued Sep. 18, 1990 for Method and Apparatus for Subsoil Drilling by Frank R. Kinnan and assigned to the assignee of the instant invention.

A generally cylindrical nose portion 22 is hingedly coupled as by pivot pin 30 to body portion 12 so that its rearward portion 24 is adjacent second end 16 of body portion 12. A shroud 32 extends from rearward portion 24 over the gap that develops (as will be described below) between rearward portion 24 and second end 16 of body portion 12 to prevent debris and soil from entering between these surfaces and preventing a face-to-face confronting position. A biasing means 34 connects body portion 12 and nose portion 22 at a position diametrically opposite the pivot pin 30 in the area below shroud 32. The biasing means 34 which may be a tension spring or a solid band of rubber urethane, having a Durometer of 80 to 90 or similar element, serves to return the body portion and nose portion to an aligned position along a common longitudinal axis 40. The combined effects of biasing means 34 and the rotation of the boring head 10 serve to maintain such alignment during drilling and return the body portion and nose portion to their aligned position once a direction change has been completed.

Figure 4:
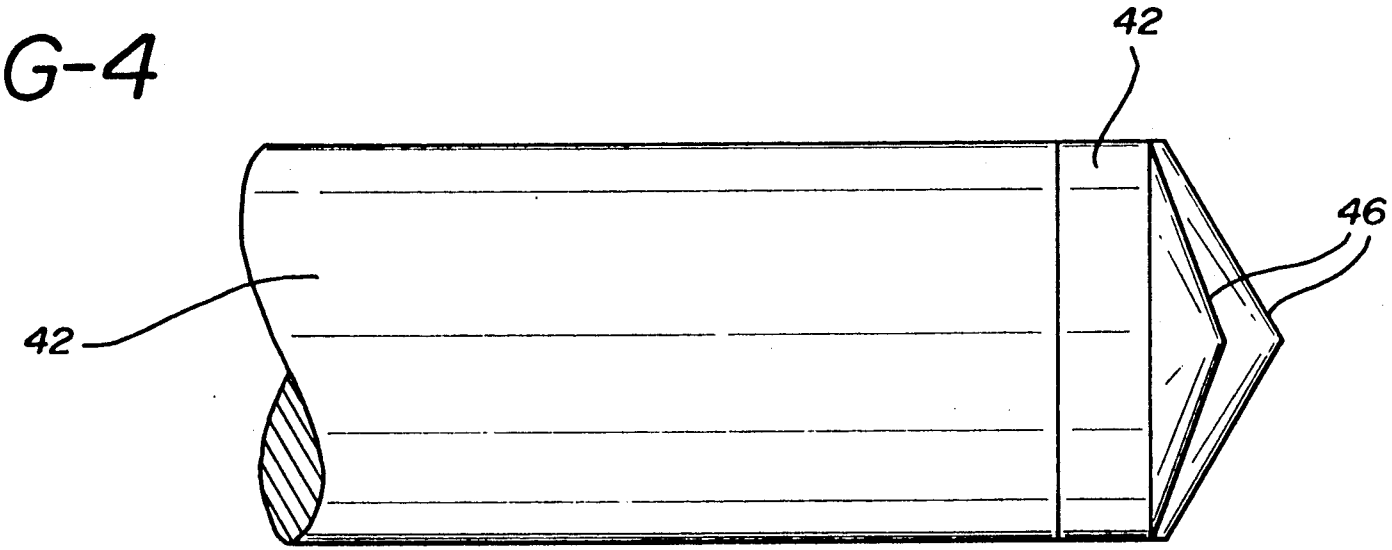
FIG. 4 is a side elevational view of an alternative construction of a boring head according to the concepts of the invention.

The forward portion of nose portion 22 is tapered as at 26 terminating in a rounded tip as at 28. Although both the body portion 12 and the nose portion 22 are made of drill grade steel, it may be desirable for very rocky or compacted soil to add a carbide boring tip 44 to nose portion 42 as shown in FIG. 4. Tip 44 would be tapered as at 46. A recess 36 (see FIG. 3) permits the spray jet from nozzle 38 to be applied as close to the longitudinal axis 40 as possible. This way, the spray jet exiting ahead of the head 10 is on-axis providing a bore somewhat less than the diameter of head 10 allowing passage of head 10 to firm up the bore walls as it passes through the bore. Nozzle 38 is fed from the pipe string via a flexible hose 39. The fluid is supplied at a pressure of about 1500 to 2000 pounds per square inch and may be water or a water/Bentonite slurry or other suitable cutting fluid.

Prior to any change in direction of boring head 10, it is necessary to accurately determine the rotational orientation of the head 10. Such a determination is made with the assistance of a transmitter of the style manufactured by the Radiodetection Corporation of Ridgewood, N.J., may be placed within a compartment 48 in nose portion 22 and suitable activated. A receiver above the soil surface (not shown) is monitored to determine the nose portion 12 rotational orientation based upon received signal strength. A signal of known magnitude would indicate that nose portion 12 was in the position shown preparatory to a downward movement as will be described below.

Figure 5:
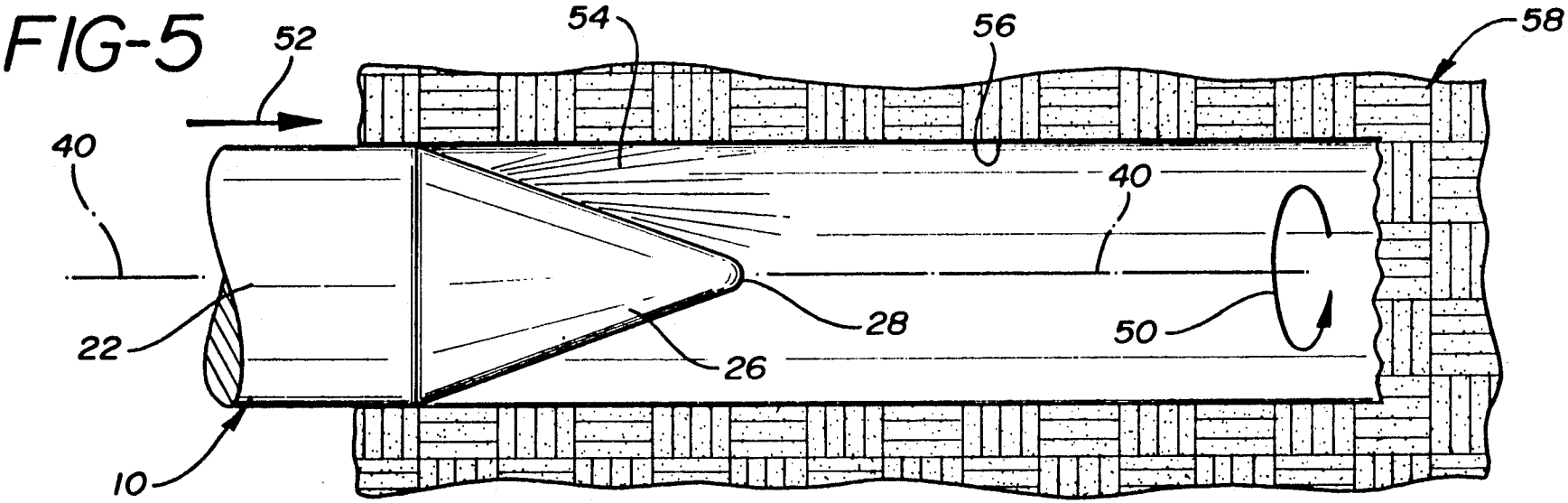
FIG. 5 is a side elevational representation of boring head of FIG. 1 during normal boring operations when it is rotated and advanced and of the resulting bore.

As is shown in FIG. 5, nose portion 12 is being rotated as shown by arrow 50 and advanced as shown by arrow 52. Spray Jet 54 as head 10 rotates cuts a bore 56 in soil 58. As long as rotation and advancing continue, the bore 56 is generally straight although some wandering naturally occurs due to differences in the soil makeup, compaction, stones, debris, etc.

Figure 6:
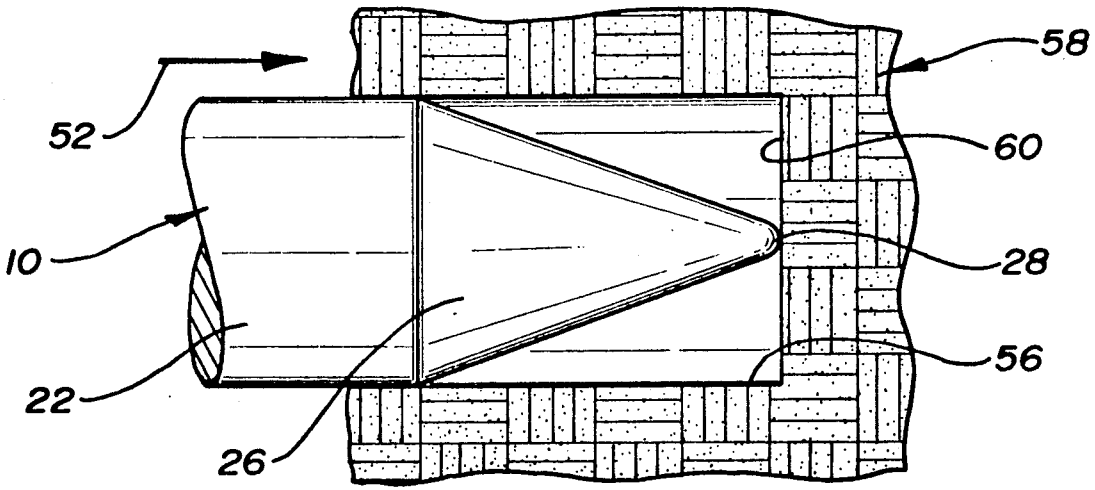
FIG. 6 is a side elevational representation of the boring head of FIG. 1 at the beginning of a change in direction operation with the nose portion in contact with the end wall of the bore.
Figure 7:
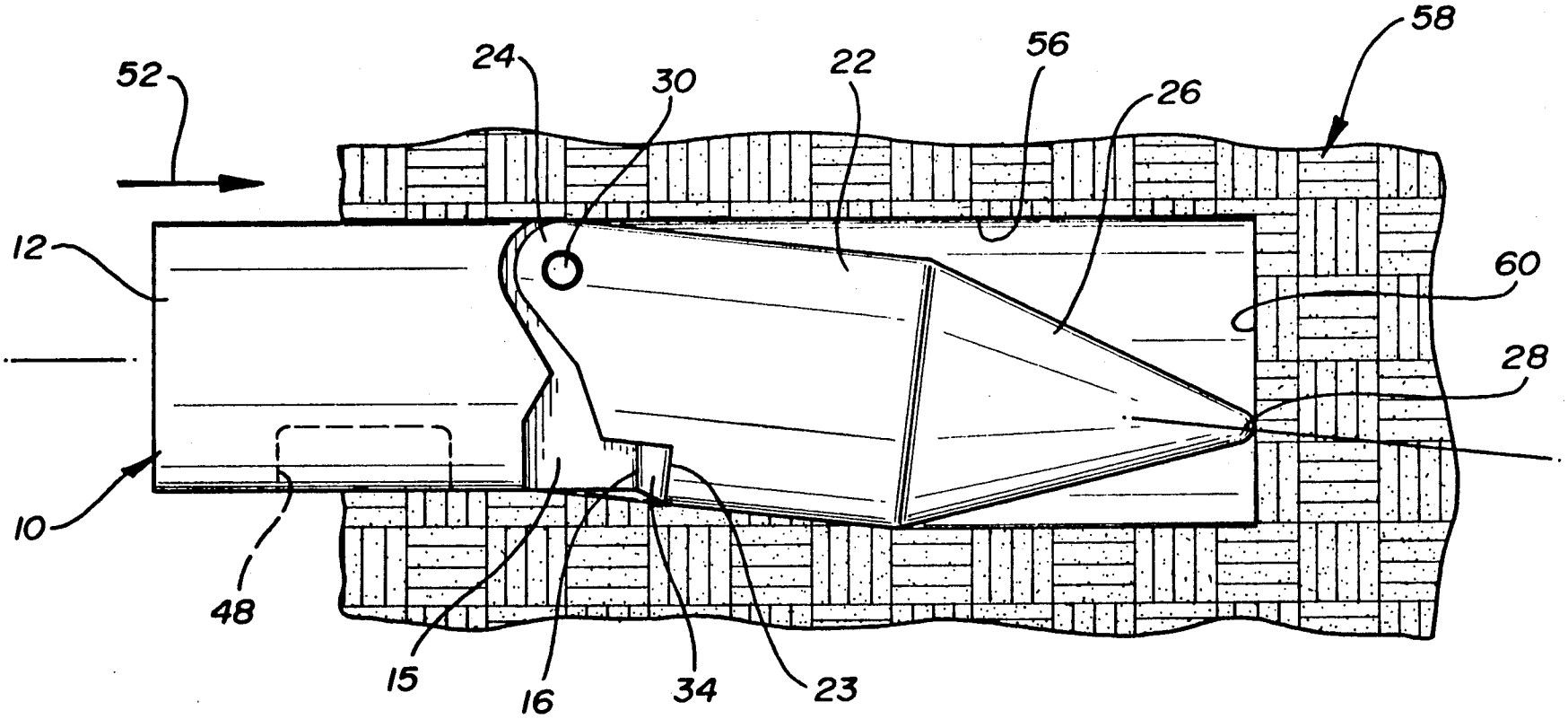
FIGS. 7 and 8 are side elevational representations of the boring head of FIG. 1 at further positions in the change-of-direction operation.
Figure 8:
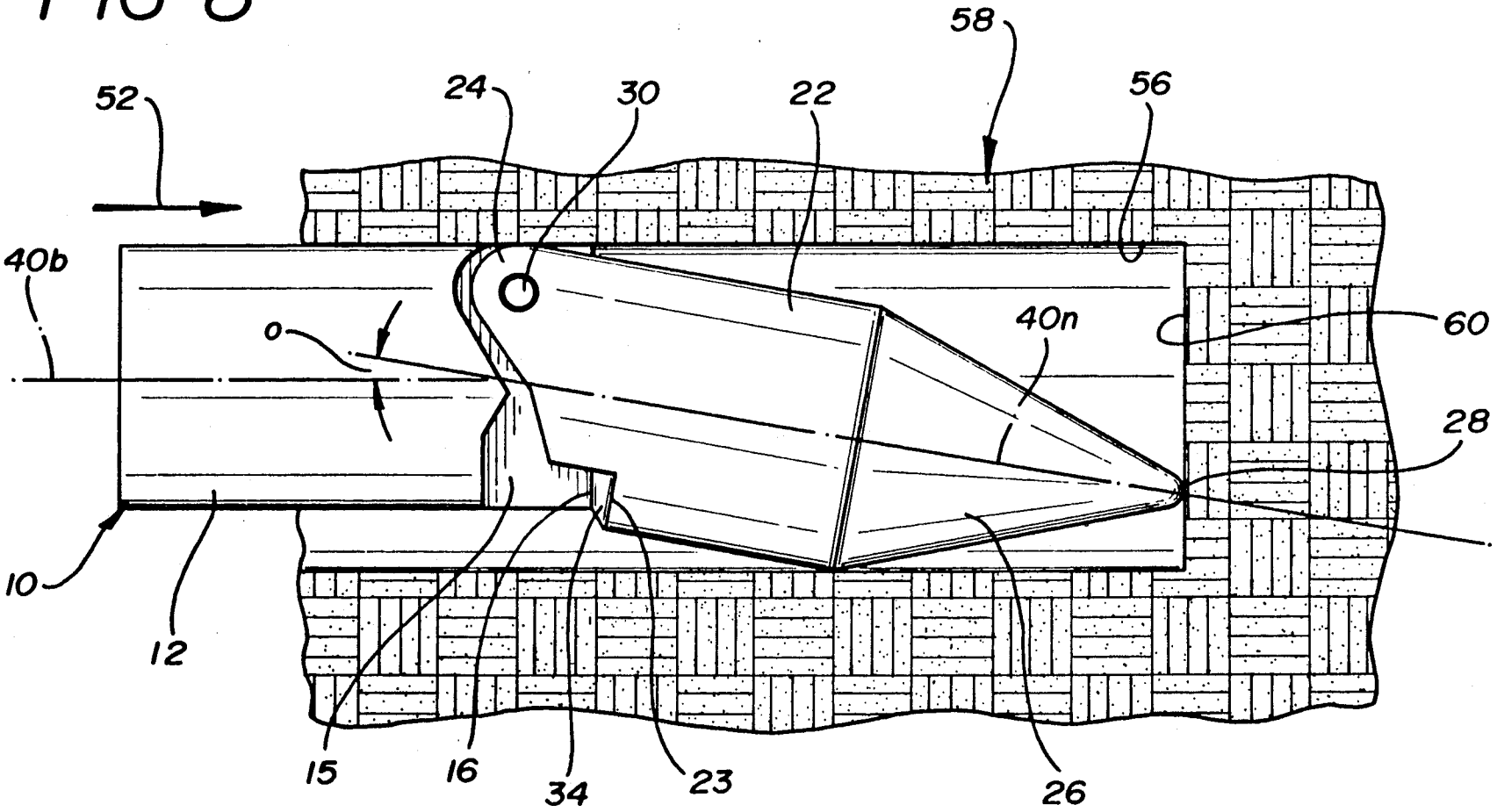

When it is desired to change the direction of movement of head 10, rotation of the head 10 is stopped and forward advance of the pipe string 18 is continued with or without the discharge of fluid which may continue to be used as a lubricant. The nose portion 22 is then brought with its tip 28 in contact with the end surface 60 of the bore 56 (see FIG. 6). The continued advance of the pipe string 18 in the direction of arrow 52 and the engagement of tip 28 of nose portion 22 causes the tip 28 to be pushed along the contour of surface 60 (see FIG. 7) and nose portion 22 to rotate clockwise about pivot pin 30. Rearward portion 24 separates from second end 16 of body portion 12 stretching biasing means 34. Shroud 32 prevents soil or debris from entering this separation and preventing later closure. The events described continue until the desired final position of head 10 is reached as is shown in FIG. 8. Note the acute angle "0" between the longitudinal axis **40*b* of body portion 12 and the longitudinal axis 40*n* of nose portion 22 which represents the desired change in direction downwardly of head 10**.

Figure 9:
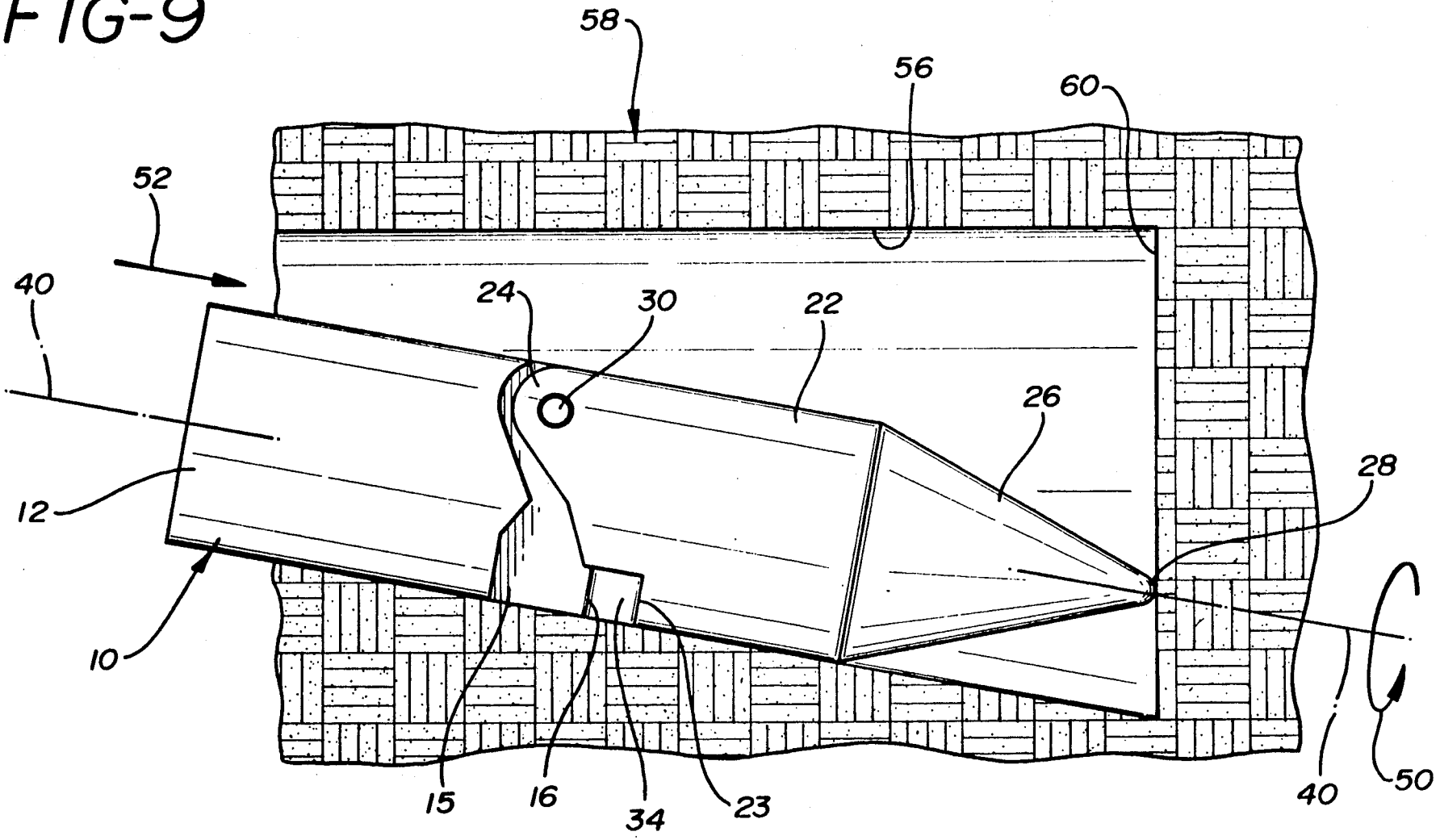
FIG. 9 is a side elevational representation of the boring head of FIG. 1 at the end of the change-of-direction operation having resumed rotation and advancement in the newly-selected boring direction.

Some additional forward thrust of head 10 seats it in the new direction and then rotation of the pipe string 18 can be initiated. The rotation of the head 10 plus the restoration forces of biasing means 34 pull body portion 12 and nose portion 22 into alignment along longitudinal axis 40 as the head 10 advances and boring continues in the newly selected direction as shown in FIG. 9.

While there have been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

The embodiments of the invention in which an exclusive property or privilege is claimed are defined as follows:

1. A boring head for a subsoil boring apparatus capable of imparting rotation and advancing said head via a pipe string coupled to said head comprising:

a body portion having a first end and a second end extending along a longitudinal axis, said body portion having a first surface and a second surface;

said first end of said body portion coupled to a pipe string;

a nose portion having a forward tapered portion for engaging the subsoil adjacent said boring head and a rearward portion, said nose portion having a third surface and a fourth surface;

a pivotal coupling for joining said nose portion to said body portion with said second end of said body portion adjacent said rearward portion of said nose portion, said pivotal coupling being located on an axis parallel with perpendicular to and displaced from the longitudinal axis of said body portion and adjacent said second surface and said fourth surface, said nose portion capable of taking positions from alignment along the longitudinal axis of said body portion with said second surface adjacent said fourth surface to an acute angle of its longitudinal axis with the longitudinal axis of said body portion; and biasing means coupled between said body portion and said nose portion adjacent said rearward portion of said nose position opposite said pivotal coupling and adjacent said first surface and said third surface to return the longitudinal axis of said nose portion into alignment with the longitudinal axis of said body portion, said body portion and said nose portion remaining aligned along a common longitudinal axis when said boring head is rotated and advanced for boring along said longitudinal axis and said nose portion being deflectable with respect to said body portion when said boring head is advanced without rotation to move in a direction at an acute angle to the longitudinal axis of said body portion.

2. A boring head as defined in claim 1, wherein said pivotal coupling is a hinge.

3. A boring head as defined in claim 1, wherein said biasing means is a spring, said spring together with the rotation of said boring head returning said nose portion into alignment with said body portion along said common longitudinal axis.

4. A boring head as defined in claim 3, wherein said spring is a compression spring.

5. A boring head as defined in claim 3, wherein said spring is a resilient elastomeric material.

6. A boring head as defined in claim 1, wherein said pivotal coupling is a hinge and said biasing means is a spring.

7. A boring head as defined in claim 1, further comprising:

nozzle means having a fluid jet exit adjacent said forward tapered portion of said nose portion;

a source of high-pressure fluid coupled to said nozzle means for passing through said nozzle means to engage subsurface soil to relieve the area ahead of said boring head, said nose portion deflecting and following the contour of said relieved area when said boring head is advanced without rotation to turn said boring head.

8. A boring head as defined in claim 7, wherein said nozzle means is located in a recess in said third surface to position said fluid jet exit closer to the longitudinal axis of said boring head.

9. A boring head as defined in claim 7, further comprising:

a radio source to permit the remote positioning of said nose portion to align said nozzle means according to the desired direction of travel of said boring head.

10. A boring head as defined in claim 1, further comprising:

a carbide bit on the free end of said forward tapered portion of said nose portion to assist in the movement of said boring head through subsoil.

11. A boring head for boring through subsoil comprising:

a body portion having a first end and a second end extending along a first longitudinal axis, a first surface and a second surface;

means for coupling drive means to said first end of said body portion;

drive means connected to said coupling means to selectively provide rotation and/or advancement whereby said body portion can be rotated while advanced or advanced without rotation;

a nose portion having a forward tapered portion for engaging the subsoil adjacent to said boring head and a rearward portion extending along a second longitudinal axis, said nose portion having a third surface and a fourth surface;

a pivotal coupling joining said rearward portion of said nose portion to said second end of said body portion, said pivotal coupling being located on an axis parallel perpendicular to with and displaced from the longitudinal axis of said body portion and adjacent said second surface and said fourth surface permitting said nose portion to take positions with respect to said body portion from alignment of said first and second longitudinal axes to an acute angle between said first and second longitudinal axes; and biasing means coupled between said rearward portion of said nose portion and said second end of said body portion adjacent said first and second surfaces to align said first and second longitudinal axes, said body portion and first longitudinal axis and said nose portion second longitudinal axis remaining aligned along a common line when said boring head is rotated and advanced for boring along said common longitudinal axis and said nose portion being deflectable with respect to said body portion when said boring head is advanced without rotation to move in a direction with said second longitudinal axis at an acute angle to said first longitudinal axis of said body portion.

12. A boring head as defined in claim 11, wherein said pivotal coupling is a hinge.

13. A boring head as defined in claim 11, wherein said pivotal coupling is a pivot pin.

14. A boring head as defined in claim 11, wherein said biasing means is a spring, said spring together with the rotation of said boring head returning said nose portion second longitudinal axis into alignment with said body portion first longitudinal axis along a common longitudinal axis.

15. A boring head as defined in claim 14, wherein said spring is a compression spring.

16. A boring head as defined in claim 14, wherein said spring is a resilient elastomeric material.

17. A boring head as defined in claim 11, wherein said pivotal coupling is a hinge and said biasing means is a spring.

18. A boring head as defined in claim 11, further comprising:

nozzle means having a fluid jet exit adjacent said forward tapered portion of said nose portion;

a source of high-pressure fluid coupled to said nozzle means for passing through said nozzle means to engage subsurface soil to relieve the area ahead of said boring head, said nose portion deflecting and following the contour of said relieved area when said boring head is advanced without rotation to turn said boring head.

19. A boring head as defined in claim 18, wherein said nozzle means is located in a recess in said third surface to position said fluid jet exit closer to said second longitudinal axis of said nose portion.

20. A boring head as defined in claim 11, further comprising:

a carbide bit on the free end of said forward tapered portion of said nose portion to assist in the movement of said boring head through subsoil.

* * * * *